US008366348B2

(12) United States Patent
Morii et al.

(10) Patent No.: US 8,366,348 B2
(45) Date of Patent: Feb. 5, 2013

(54) RAISED STATE HOLDING MECHANISM OF FLAP GATE FOR BREAKWATER

(75) Inventors: Toshiaki Morii, Osaka (JP); Kyouiti Nakayasu, Osaka (JP); Yuitirou Kimura, Osaka (JP)

(73) Assignee: Hitachi Zosen Corporation, Osaka (JP)

( * ) Notice: Subject to any disclaimer, the term of this patent is extended or adjusted under 35 U.S.C. 154(b) by 0 days.

(21) Appl. No.: 13/510,441

(22) PCT Filed: Sep. 24, 2010

(86) PCT No.: PCT/JP2010/066536

§ 371 (c)(1),
(2), (4) Date: May 17, 2012

(87) PCT Pub. No.: WO2011/074303

PCT Pub. Date: Jun. 23, 2011

(65) Prior Publication Data

US 2012/0237297 A1 Sep. 20, 2012

(30) Foreign Application Priority Data

Dec. 15, 2009 (JP) ..... 2009-284266

(51) Int. Cl.
*E02B 7/40* (2006.01)
*E02B 7/20* (2006.01)

(52) U.S. Cl. ..... 405/100; 405/87; 210/170.1

(58) Field of Classification Search ..... 405/21, 405/28, 87, 100; 210/170.1
See application file for complete search history.

(56) References Cited

FOREIGN PATENT DOCUMENTS

| | | |
|---|---|---|
| JP | 03-202503 A | 9/1991 |
| JP | 3019522 U | 10/1995 |
| JP | 3042896 U | 8/1997 |

OTHER PUBLICATIONS

International Preliminary Report on Patentability in corresponding International Application No. PCT/JP2010/066536, dated Jul. 19, 2012, 5 pages.
International Search Report for International Application No. PCT/JP2010/066536, dated Oct. 26, 2010, 1 page.

*Primary Examiner* — Tara Mayo-Pinnock
(74) *Attorney, Agent, or Firm* — Brinks Hofer Gilson & Lione

(57) ABSTRACT

To make it possible to hold a door body in an immobilized state without oscillating when the raising operation has been completed. A raised state holding mechanism of a flap gate for a breakwater provided with a two-folding support rod which immobilizes and supports a door body the front end side of which is supported to freely rise or lower with a rotating shaft as a supporting point, and a stay which supports this and to which is attached a guide roller the movement of which is guided by a guide rail. Between a two-rod double-acting cylinder device and an oil tank there is a raising side oil supply pathway which supplies oil to a raising side oil chamber, a raising side oil discharge pathway which discharges oil from the raising side oil chamber, and a lowering side oil pathway which supplies/discharges oil to a lowering side oil chamber. A check valve is provided to the raising side oil supply pathway, and a shut-off valve is provided to the raising side oil discharge pathway to prevent lowering of the door body during the operation of raising the door body and after raising of the door body is completed. It becomes possible to hold a door body in an immobilized state without oscillating when the raising operation has been completed.

4 Claims, 7 Drawing Sheets

(a)

(b)

(a)

(b)

RAISED STATE HOLDING MECHANISM OF FLAP GATE FOR BREAKWATER

This application is a 371 application of PCT/JP2010/066536 having an international filing date Sep. 24, 2010, which claims priority to JP2009-284266 filed Dec. 15, 2009, the entire contents of which are incorporated herein by reference.

TECHNICAL FIELD

The present invention relates to a raised state holding mechanism of a flap gate for a breakwater, which uses a wave force during a raising operation to raise a door body which is immobilized so that it does not oscillate when the raising operation has been completed, and which achieves a mechanism which prevents a propagation of waves from outside of a harbor to inside of a harbor.

BACKGROUND ART

In the past, the two following types of flap gates were known.

The first type had a cylinder device 1 installed under water which was used to raise and lower the front end side of a flap gate 2 which was supported on a base end side to rotate freely, using the base end side as a supporting point, as shown in FIG. 8. In an example of this type. Patent Reference 1 disclosed a flap gate which has a rod end of a tilted jack of a door body installed, for rotation with respect to the door body, in an attachment hole formed on the sea bed on the downstream side of the door body, so that the door body oscillates between the raised position and the lowered position.

The second type had a winch 3 installed on land which was used to raise and lower the front end of a flap gate 2 whose base end side was supported to rotate freely, using the base end side as a supporting point, as shown in FIG. 9. In an example of this type, Patent Reference 2 disclosed a flap gate in which the winch is driven by winding a rope upwards so as to raise a door body.

However, in the type disclosed in Patent Reference 1, the cylinder is set in one direction and is able only to operate so as to push the door body in a raising direction. In the type disclosed in Patent Reference 2, the winch is set in one direction and is able to only operate to raise the door body by winding the rope upwards. Therefore, there is a problem that if a force acts in a raising direction, the door body will oscillate, and as a result, waves will propagate in the inside of the harbor.

Patent Reference 1: Japanese Patent Application Kokai Publication No. H03-202503

Patent Reference 2: Japanese Utility Model Registration No. 3042896

SUMMARY OF THE INVENTION

Problems to be Solved by the Invention

The problem which the present invention aims to solve is that when a conventional flap gate was in a state in which the raising operation was completed, it was impossible to hold the door body in an immobilized state against wave forces from both inside a harbor and from outside of a harbor, so the door body oscillated.

Means for Solving this Problem

The raised state holding mechanism of a flap gate for a breakwater according to the present invention was devised to make it possible to hold a door body in an immobilized state against wave forces from both inside a harbor and from outside of a harbor, and comprises a door body which has a buoyancy chamber, and a front end side which is supported to freely rise and lower with a rotating shaft on the base end side as a supporting point, a two-folding support rod for immobilizing and supporting the door body when it is raised, having one end part connected to the front end part side of the door body to rotate freely, while the other end part is supported so as to rotate freely in a position at a specified distance from the rotating shaft on the side where the door body lowers, and the one end part and the other end part have a connecting member between them, and a base end side connecting rod on the other end side and a front end side connecting rod on the one end side fold by means of this connecting member, a stay which supports the support rod when the door body is in a raised state, and one end part of the stay is connected to rotate freely in the middle of the base end side connecting rod of the support rod, and a guider roller is attached to the other end part of the stay to rotate freely, a guide rail for guiding the guide roller which moves between the raised position and the lowered position of the door body, together with changes which occur between the two-folded state and the elongated state of the support rod, and a raising limit stopper which restricts the movement of the guide roller in a raising direction, and the raised state holding mechanism of a flap gate for a breakwater raises or lowers the door body in an inclined state by supplying air to the buoyancy chamber or by discharging air from the buoyancy chamber, and comprises as its most essential elements:

movable pulleys attached to the ends of both rods of a two-rod double-acting cylinder device, with the other ends of the ropes wound around these two movable pulleys, with one rope in the direction in which the door body rises, while the other rope is in the direction in which the door body lowers, each being attached to its respective guide roller, so that a piston of the double-acting cylinder device moves according to the raising and lowering of the door body, and a stroke sensor which detects the position of the piston is provided to the double-acting cylinder device, and a hydraulic pathway between an oil tank and the double-acting cylinder device has a raising side oil supply pathway which supplies oil to a raising side oil chamber on the side of one rod where one rope is wound, and a raising side oil discharge pathway which discharges oil from the same raising side oil chamber on the side of the one rod, and a lowering side oil supply pathway for supplying and discharging oil in a lowering side oil chamber on the side of the other rod where the other rope is wound, and a shut-off valve is provided in the raising side oil discharge pathway to prevent the discharge of oil from the raising side oil chamber, and a check valve is provided in the raising side oil supply pathway to prevent the discharge of oil from the raising side oil chamber, if a force in a lowering direction acts on the door body during the operation of raising the door body and when raising of the door body is completed, and to prevent lowering of the door body during the operation of raising the door body and when raising of the door body has been completed.

The present invention employs the two-rod double-acting cylinder device as a raised state holding mechanism of the door body. Also, a shut-off valve is provided in the raising side oil discharge pathway to discharge oil from the raising side oil chamber, and a check valve is provided in the raising side oil supply pathway which supplies oil to the raising side oil chamber to stop only the flow of oil from the raising side oil chamber. Therefore, the raised position is supported against a wave force in the lowering direction during the operation of raising the door body, and conversely, the wave force in the raising direction is employed to raise the door body. In addition, the position after completion of raising can be supported even when forces in the lowering direction act on the door body after the raising operation has been completed.

In the present invention, if an auxiliary oil supply pathway is connected to the raising side oil supply pathway, the piston is operated in the raising direction exceeding the discharge amount equivalent of a hydraulic pump during the operation of raising the door body, and even if there is insufficient oil in the raising side oil supply pathway, the amount of oil that is lacking is supplied via the auxiliary oil supply pathway.

In the present invention, if a safety valve is provided in the raising side oil supply pathway or the raising side oil discharge pathway, the oil pathways can be safely protected, during the operation of raising the door body or after raising of the door body is completed, even if a force which exceeds expectations acts in the lowering direction.

Advantageous Effects of the Invention

According to the present invention, a wave force is employed in the direction to raise the door body during the operation of raising the door body, because a check valve is provided in the raising side oil supply pathway which supplies oil to the raising side oil chamber of the two-rod double-acting cylinder which moves together with the rising motion due to the buoyancy of the door body. Even if a wave force acts to cause the door body to be lowered, the raised position can be maintained. Moreover, when the door body is in position after completion of raising, immobilization of the door body can be maintained against wave forces from both inside a harbor and from outside of a harbor, due to the fact that the support rods are maintained in a rectilinear state.

DETAILED DESCRIPTION OF THE PREFERRED EMBODIMENTS

According to the present invention, the object of preventing a lowering of the door body during the operation of raising the door body, or when the raising operation has been completed, is achieved by providing a check valve in the raising side oil supply pathway which supplies oil to the raising side oil chamber of the two-rod double-acting cylinder which moves together with the raising motion due to the buoyancy of the door body.

Example

An example of the present invention is described in detail below using FIG. 1 to FIG. 7.

Figure 1:
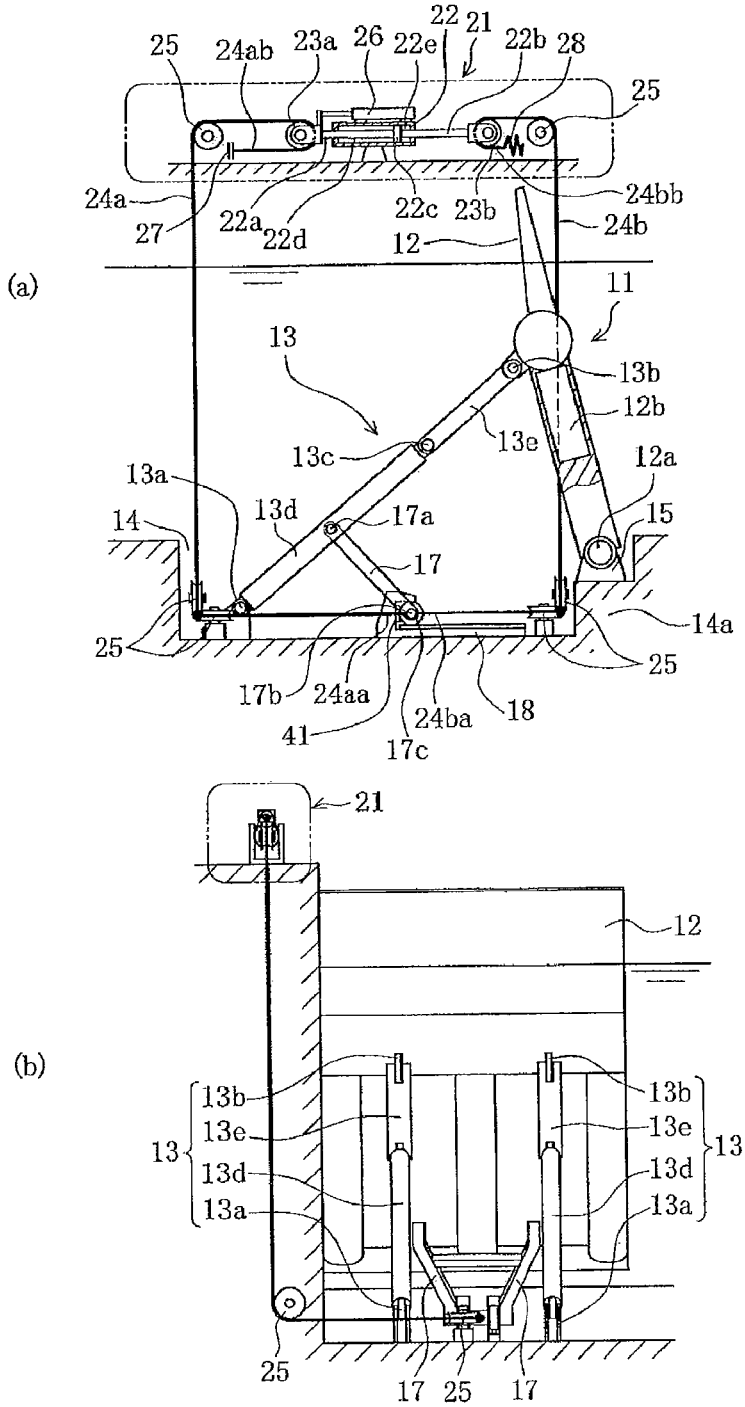
FIG. 1 is a schematic drawing of the raised state holding mechanism of the flap gate for a breakwater according to the present invention, where (a) is a frontal view and (b) is a side view.

FIG. 1 is a schematic drawing of the raised state holding mechanism of the flap gate for a breakwater according to the present invention.

In FIG. 1, Reference Numeral 11 is a flap gate for a breakwater, and is provided, for example, with a door body 12 and a plurality of support rods 13 which immobilize and support the door body 12 when raising the door body 12.

The door body 12 has a rotating shaft 12*a* on the base end side which is supported by a bearing 15 so as to freely rotate on a base platform 14*a* of a containment structure 14 provided with an integrated structure on the bottom of a harbor, and the front end side rises or lowers with the rotating shaft 12*a* as the supporting point.

Figure 2:
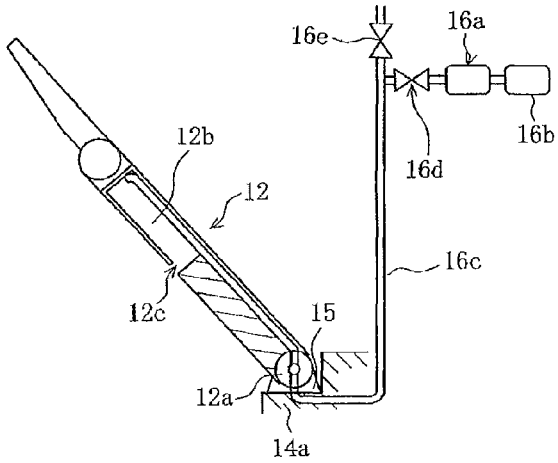
FIG. 2 is a schematic drawing illustrating the raising and lowering mechanism of the flap gate for a breakwater employing the raised state holding mechanism of the present invention.

The door body 12 is also provided, for example, with a buoyancy chamber 12*b* on its front end side, and, as shown in FIG. 2, and is structured so as to produce a buoyancy required to raise the door body 12 by supplying air to the buoyancy chamber 2*b* by means of an accumulator tank 16*a* and a compressor 16*b* via a supply/discharge duct 16*c*. It should be noted that in FIG. 2, 16*d* is an air supply valve, and 16*e* is an air discharge valve.

The support rod 13 immobilizes and supports the door body 12, so that the door body 12 can be kept in an inclined state as shown in FIG. 1 (*a*) during raising, and has the following structure.

The support rod 13 has another end part 13*a* which is supported so as to rotate freely at a position of the containment structure 14 at a specified distance from the rotating shaft 12*a* on the side where the door body 12 lowers. One end part 13*b* is supported so as to freely rotate at the door body 12.

Also, the one end part 13*b* is formed so as to rise with the other end part 13*a* as the supporting point, as a result of the raising of the door body 12 with the rotating shaft 12*a* as the supporting point.

The support rod 13 has a connecting member 13*c* in a position between the one end part 13*b* and the other end part 13*a* toward the front end. A base end side connecting rod 13*d* which holds the connecting member 13*c* and the other end part 13*a* at each of its ends, and the front end connecting rod 13*e* which holds the connecting member 13*c* and the one end part 13*b* at each of its ends are formed so that the connecting member 13*c* folds.

Therefore, the support rod 13 transmits only axial force. Accordingly, as shown in FIG. 1 (*a*), when the base side connecting rod 13*d* and the front end side connecting rod 13*e* are in an extended rectilinear state, the connecting member 13*c* does not generate a flexural force, even if a force acts in a direction to lower the door body 12. It is sufficient for a stay 17 described below to apply just supporting force for the support rod 13 to bend due to its own weight.

Reference Numeral 17 is a stay disposed between the base end side connecting rods 13*d* of the support rod 13, and is supported by a one end part 17*a* which rotates freely, and a guide roller 17*c* is attached to the other end part 17*b* to rotate freely. When the support rod 13 rises, as it rises, the guide roller 17*c* is guided by the guide rail 18 and moves to the side of the other end part 13*a* of the support rod 13.

Figure 3:
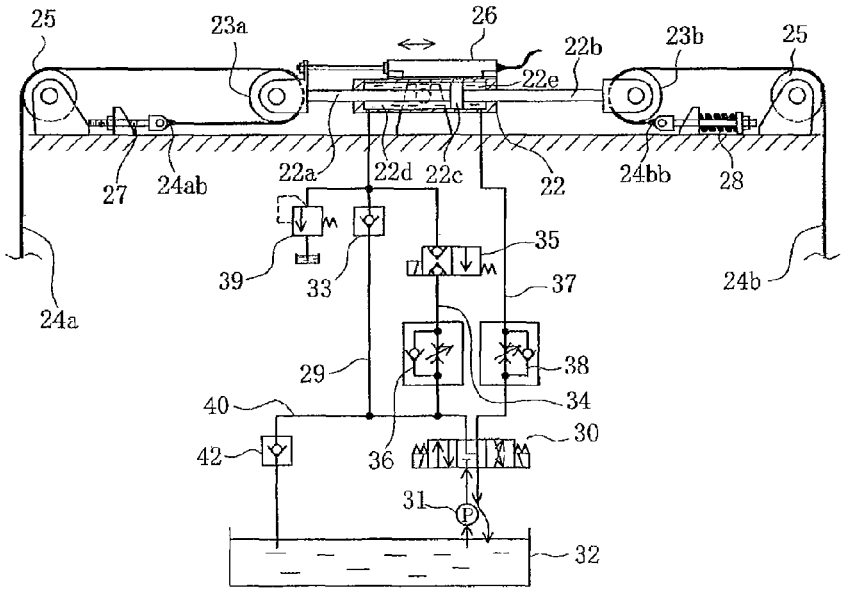
FIG. 3 is a detailed drawing of the raised state holding mechanism of the flap gate for a breakwater according to the present invention
Figure 4:
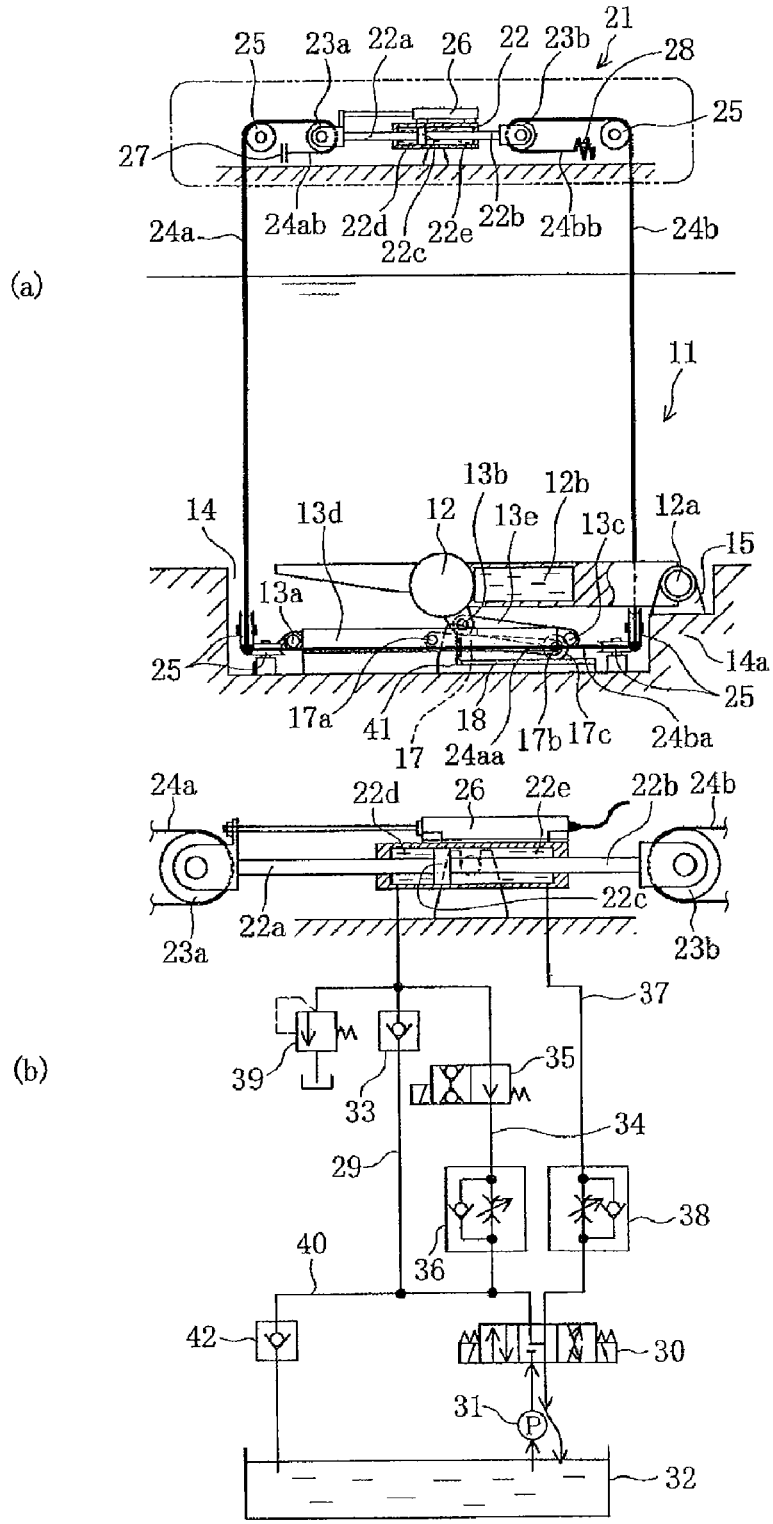
FIG. 4 is a drawing illustrating the operation of the raised state holding mechanism of a flap gate for a breakwater according to the present invention when it is being contained, where (a) is a frontal view and (b) drawing illustrating the hydraulic pathways to the double-acting cylinder device.

Reference Numeral 21 is a raised state holding mechanism for preventing lowering of the door body 12 during the operation of raising the door body 12 by supplying air to the buoyancy chamber 12*b* of the door body 12 and also when the raising operation has been completed, as shown in FIG. 3.

Reference Numeral 22 is a two-rod double-acting cylinder device installed on land, and movable pulleys 23*a* and 23*b* are attached to the front ends of the two rods 22*a* and 22*b*, and ropes 24*a* and 24*b* are wrapped around the movable pulleys 23*a* and 23*b*, respectively.

Of these ropes 24*a* and 24*b*, one rope 24*a* is attached so that its other end 24*aa* is led to the guide roller 17*c* and guided to a fixed pulley 25, so that piston 22*c* moves together with the raising of the door body 12. The other rope 24*b* is attached so that its other end 24*ba* is led to the guide roller 17*c* and guided to the fixed pulley 25, so that piston 22*c* moves together with the lowering of the door body 12. The position of this moving piston 22*c* is such that it can be detected by a stroke sensor 26 attached to the double-acting cylinder device 22.

One end 24*ab* of the one rope 24*a* is attached to a rope end adjusting device 27, and is formed to adjust its attaching length. Another end 24*bb* of the other rope 24*b* is attached to a rope tension adjusting device 28, and is formed to make it possible to adjust the tension of the other rope 24*b*.

In the present invention, hydraulic pathways to the double-acting cylinder device 22 are formed as described below.

Reference Numeral 29 is a raising side oil supply pathway for supplying oil by a hydraulic pump 31 from an oil tank 32 via a direction-switching valve 30, to a raising side oil chamber 22*d* on the side of one rod 22*a* where one rope 24*a* is wound, and a check valve 33 is disposed in this pathway.

Reference Numeral 34 is a raising side oil discharge pathway which returns oil discharged from the raising side oil chamber 22*d* to the oil tank 32, and connects the downstream side of the direction-switching valve 30 with the downstream side of the check valve 33, and shut-off valve 35 and a flow adjustment valve 36 with a check valve are provided in the pathway from the raising side oil chamber 22*d*.

It should be noted that when the shut-off valve 35 is in the "open" position, oil is allowed to be discharged from the raising side oil chamber 22*d* via the raising side oil discharge pathway 34, and when it is in the "closed" position, oil is not allowed to be discharged.

Reference Numeral 37 is a lowering side oil pathway which connects the downstream side of the direction-switching valve 30 with a lowering side oil chamber 22*e* on another rod 22*b* around which the other rope 24*b* winds. This lowering side oil pathway 37 returns the oil discharged from the lowering side oil chamber 22*e* to the oil tank 32 during raising, and supplies oil to the lowering side oil chamber 22*e* during lowering, and a flow adjustment valve 38 with a check valve is disposed in this pathway.

It should be noted that the flow adjustment valves 36 and 38 with check valves disposed in the raising side oil discharge pathway 34 and the lowering side oil pathway 37 are provided regulate the flow of oil returning to the oil tank 32 through the oil pathways 34 and 37, so as to control the operating speed of the double-acting cylinder device 22.

Reference Numeral 39 is a safety valve joined at the confluence of the raising side oil supply pathway 29 and the raising side oil discharge pathway 34. Reference Numeral 40 is an auxiliary oil pathway connected between the check valve 33 of the raising side oil supply pathway 29 and the direction-switching valve 30, to supply oil from the oil tank 32 as an auxiliary. A check valve 42 is disposed in this pathway.

The raised state holding mechanism 21 having the above-described structure can be used to modify the state to be in a free state (when the door body 12 is being contained), a unidirectional operating state in the raising direction, whereby raising is possible and lowering is impossible (during the raising operation and when the raising operation has been completed), or a lowering direction operating state (during the lowering operation), by shut-off valve 35 and switching the direction-switching valve 30.

Following is a description of the operation of the raised state holding mechanism 21 having the above-described structure, according to various operating steps.

During Containment: See FIG. 4

Here, the door body 12 has been lowered to a state in which the buoyancy chamber 12*b* is filled with water. At this time, the raised state holding mechanism 21 is in a state such that oil pass through the two oil chambers 22*d* and 22*e*, because the direction-switching valve 30 is in a "neutral" position without excitation, and the shut-off valve 35 is in an "open" position without excitation, so oil within the oil tank 32 is not supplied to the raising side oil chamber 22*d* or to the lowering side oil chamber 22*e*.

In the case of the above state, the piston 22*c* of the double-acting cylinder device 22 moves in the direction of a force acting on the door body 12, and the oil traverses the raising side oil chamber 22*d* and the lowering side oil chamber 22*e* together with the movement of the piston 22*c*.

During the Raising Operation: See FIG. 5

Water within the buoyancy chamber 12*b* is expelled from an opening 12*c* (refer to FIG. 2) of the door body 12 when the air supply valve 16*d* is set to "open" and the air within the accumulator tank 16*a* is supplied to the buoyancy chamber 12*b*, with the result that the front end side of the door body 12 rises, with the rotating shaft 12*a* as a supporting point, so the door body 12 starts to rise.

Figure 5:
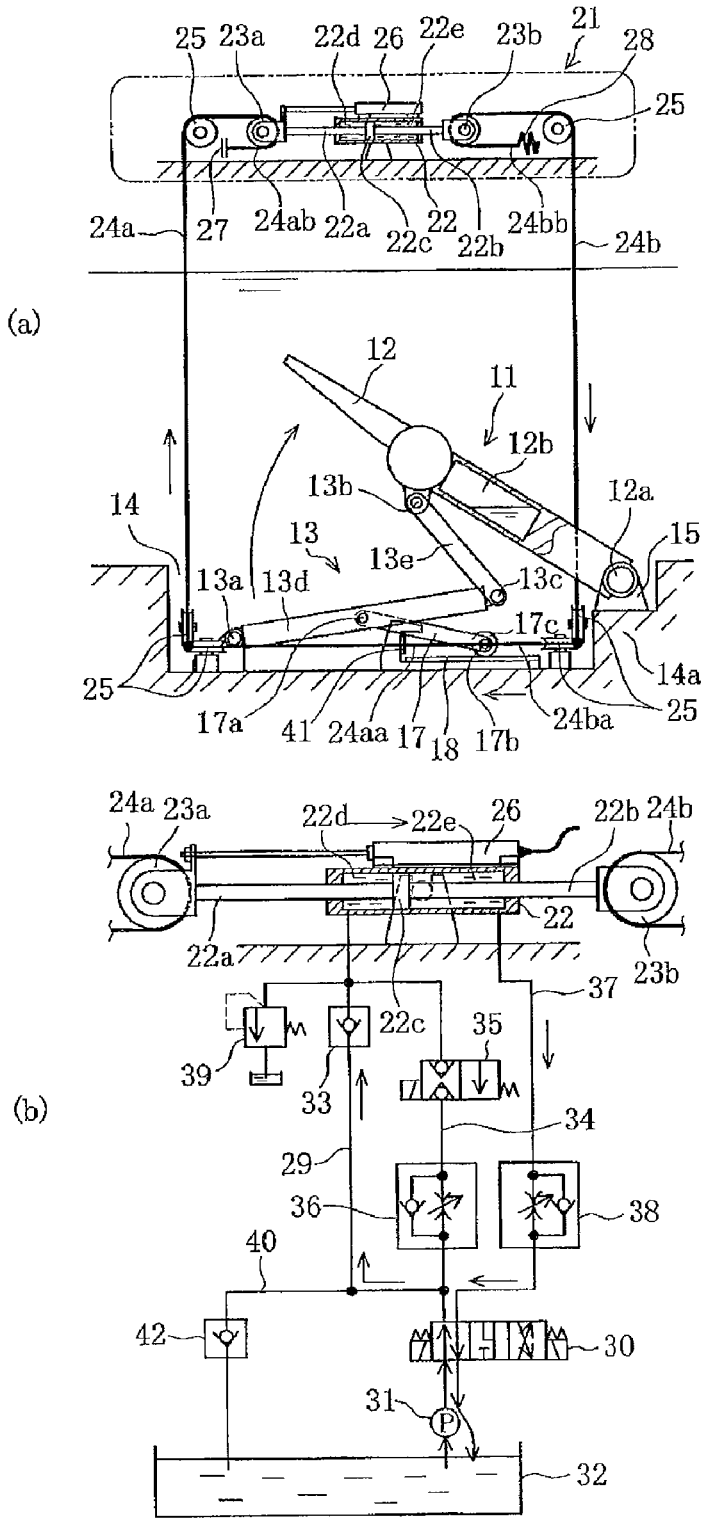
FIG. 5 is a drawing illustrating the operation of the raised state holding mechanism of a flap gate for a breakwater according to the present invention during the operation of raising the door body, where (a) is a frontal view and (b) is a drawing illustrating the hydraulic pathways to the double-acting cylinder device, and a drawing illustrating the hydraulic pathways when the amount of oil that is lacking is supplied via the auxiliary oil supply pathway if the piston is operated in the raising direction exceeding the discharge amount equivalent of a hydraulic pump.
Figure 6:
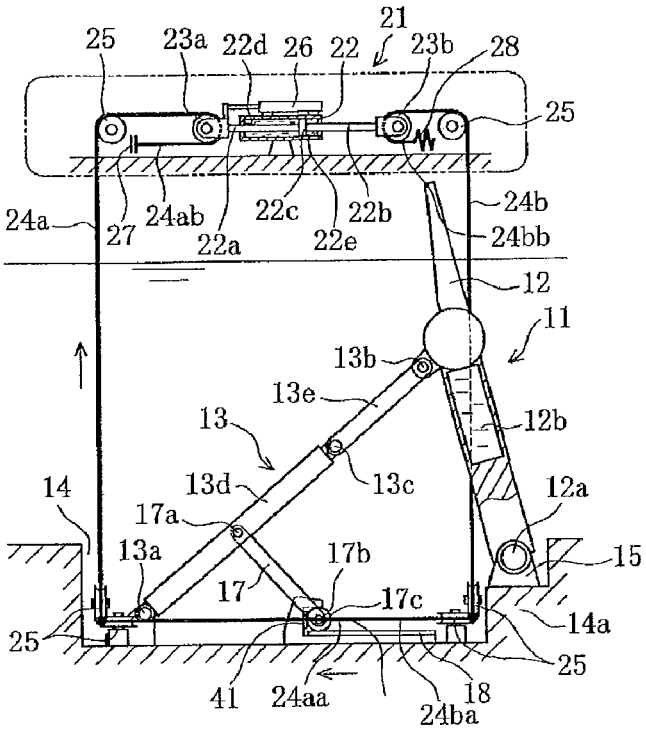
FIG. 6 is a drawing illustrating the operation of the raised state holding mechanism of a flap gate for a breakwater according to the present invention when the raising operation has been completed, where (a) is a frontal view and (b) is a drawing illustrating the hydraulic pathways to the double-acting cylinder device.
Figure 6:
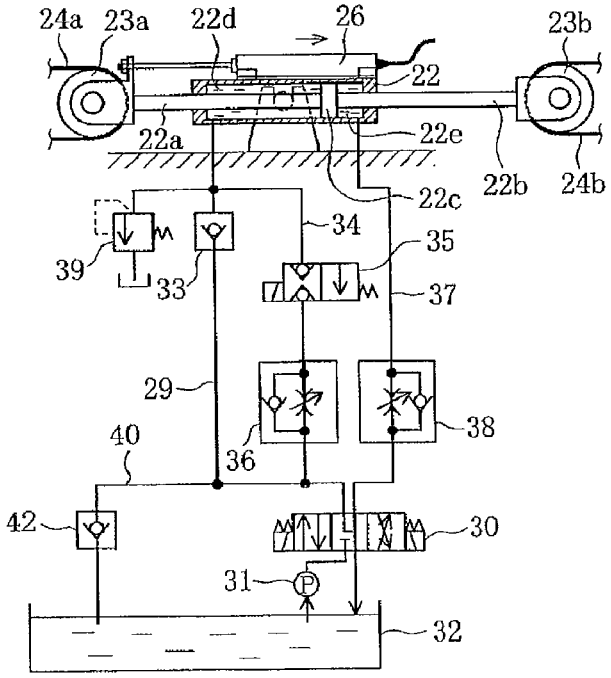
Figure 7:
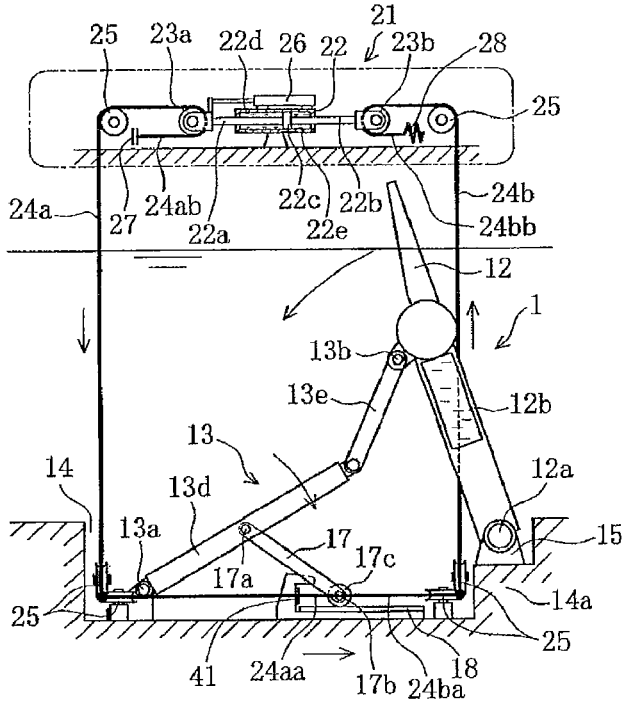
FIG. 7 is a drawing illustrating the operation of the raised state holding mechanism of a flap gate for a breakwater according to the present invention during the lowered state, where (a) is a frontal view and (b) is a drawing illustrating the hydraulic pathways to the double-acting cylinder device.
Figure 7:
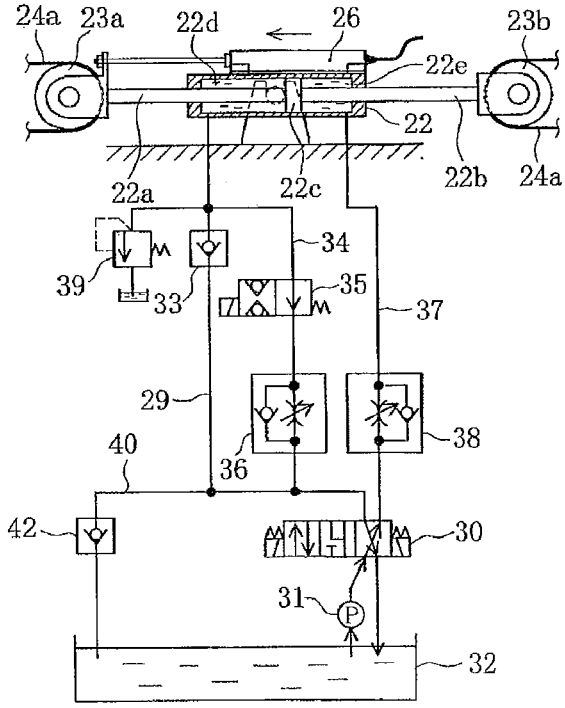
Figure 8:
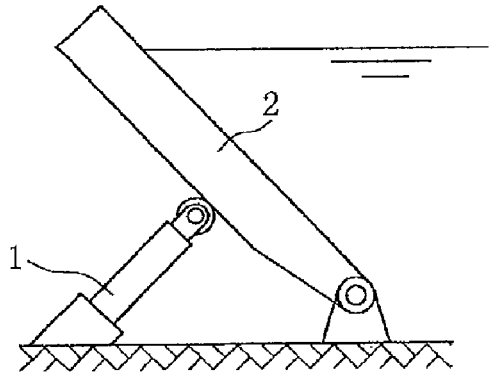
FIG. 8 PRIOR ART
FIG. 8 is a drawing illustrating the first type of flap gate for a breakwater, which is raised or lowered by means of a cylinder installed in water.
Figure 9:
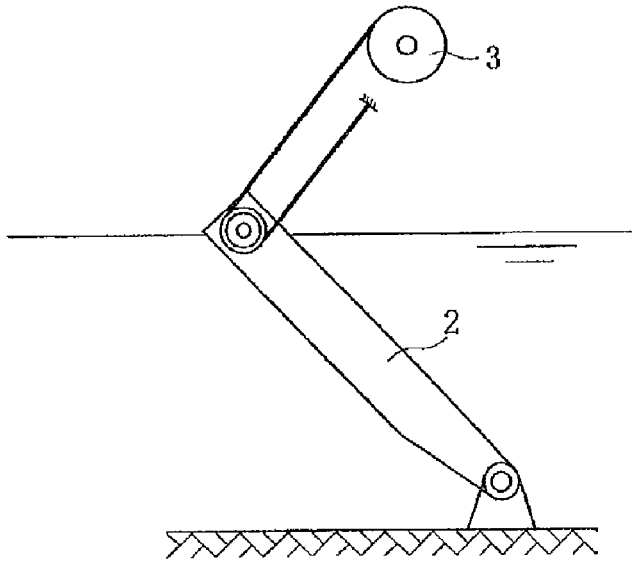
FIG. 9 PRIOR ART
FIG. 9 is a drawing illustrating the second type of flap gate for a breakwater, which is raised or lowered by means of a winch installed on land.

At this time, the raised state holding mechanism 21 is in such a state that the direction-switching valve 30 is excited and set in a "raise" position, while the shut-off valve 35 is set in a "closed" position (see FIG. 5 (*b*)). In this case, oil in the oil tank 32 is only supplied to the raising side oil chamber 22*d* through the raising side oil supply pathway 29, so that the oil in the raising side oil chamber 22*d* operates unidirectionally in the raising direction, without passing through the raising side oil discharge pathway 34. Moreover, the oil in the lowering side oil chamber 22*e* passes through the lowering side oil pathway 37, returning to the oil tank 32.

During this raising operation, if the piston 22*c* is operated in the raising direction exceeding the discharge amount equivalent of the hydraulic pump 31, the oil within the raising side oil chamber 22*d* and the raising side oil supply pathway 29 is insufficient, giving rise to a negative pressure.

However, in the above-described example of the present invention, if such a state arises, the insufficient amount of oil is automatically supplemented, being supplied from the oil tank 32 to the raising side oil supply pathway 29 and the raising side oil chamber 22*d* via the auxiliary oil pathway 40. (see FIG. 5 (*b*)). Once a position is reached in which the raising operation has been completed, the guide roller 17*c* attached to the other end part 17*b* of the stay 17 presses on a raising limit stopper 41, so that the motion in the raising direction is restricted. In this position, the base end side connecting rod 13*d* and the front end connecting rod 13*e* of the support rod 13 are in an extended rectilinear state.

When the Raising Operation has been Completed: See FIG. 6

When the stroke sensor 26 detects a raising limit of the door body 12, the direction-switching valve 30 is switched to a "neutral" position, so that the oil in the oil tank 32 will not be supplied to the raising side oil chamber 22*d* and the lowering side oil chamber 22*e*. Furthermore, the shut-off valve 35 is in the "closed" position, and flow from the raising side oil chamber 22*d* is stopped by the shut-off valve 35 and check valve 33, thereby stopping the motion of the piston 22*c* in the lowering direction.

Accordingly, the movement of the guide roller 17*c* attached to the other end part 17*b* of the stay 17 is restricted, and the one end part 17*a* of the stay 17 supports the underside of the support rod 13 when it is in an extended rectilinear state.

After raising of the door body 12 has been completed, the air supply valve 16*d* is set to "closed" and the air discharge valve 16*e* is set to "open," such that air escapes from the buoyancy chamber 12*b*, while water flows in via the opening 12*c*, filling the buoyancy chamber 12*b*. The door body 12, which is provided with the buoyancy chamber 12*b* which is now filled with water, does not lower, because it is supported by the support rod 13.

In the state when the raising operation has been completed, a force does not arise to bend the support rod 13, even if a wave force acts in the direction in which the door body 12 lowers, because the support rod 13 is supported in an extended rectilinear state. Therefore, basically no abnormally high pressure is generated in the double-acting cylinder device 22 which supports the support rod 13 in an extended rectilinear state via the stay 17.

In the unlikely event that an abnormally high pressure were to act on the double-acting cylinder device 22 due to a wave force exceeding expectations acting in the direction in which the door body 12 lowers, oil would escape from the safety valve 39 and the piston 22*c* would move in a lowering direction. However, in such an event, the movement of the piston 22*c* would be monitored by the stroke sensor 26, so in the event that it is necessary to support the raised state, the direction-switching valve 30 should once again be switched to the "raise" position, and at the same time, the hydraulic pump 31 should be driven so that oil is supplied from the oil tank 32 to the raising side oil chamber 22*d*.

In such an event, when the raising limit is detected by the stroke sensor 26, the direction-switching valve 30 is switched to the "neutral" position, thereby stopping the flow of oil from the raising side oil chamber 22*d*, so as to stop the movement of the piston 22*c* in the lowering position.

During the Lowering Operation: See FIG. 7

During the lowering operation, the direction-switching valve 30 is excited and switched to the "lower" position, and oil is supplied from the oil tank 32 to the lowering side oil chamber 22*e*. Furthermore, the shut-off valve 35 is set to the "open" position, and oil is returned to the oil tank 32 from the raising side oil chamber 22*d* through the raising side oil discharge pathway 34.

As a result of the above operation, the guide roller 17*c* attached to the other end part 17*b* of the stay 17 is caused to move in the lowering direction. Accordingly, the support rod 13 is released from the extended rectilinear state and bends in two at the connecting member 13*c*, and at the same time, the door body 12 naturally lowers.

The present invention is not limited to the above-described example, and the preferred embodiment may, of course, be advantageously modified within the scope of the technical ideas recited in the claims.

INDUSTRIAL APPLICABILITY

The present invention can be installed not only in harbors, but it can also be installed in rivers as well.

The invention claimed is:

1. A raised state holding mechanism of a flap gate for a breakwater, comprising:

a door body which has a buoyancy chamber, and a front end side which is supported to freely rise and lower with a rotating shaft on a base end side of the door body as a supporting point;

a two-folding support rod for immobilizing and supporting the door body when it is raised, the two-folding support rod having one end part connected to the front end part side of the door body to rotate freely, while the other end part thereof is supported so as to rotate freely in a position at a specified distance from a rotating shaft on a side where the door body lowers, the one end part and the other end part having a connecting member between them, wherein a base end side connecting rod on the other end side and a front end side connecting rod on the one end side fold by means of the connecting member;

a stay which supports the support rod when the door body is in a raised state, one end part of the stay being connected to rotate freely in the middle of the base end side connecting rod of the support rod, and a guider roller being attached to the other end part of the stay to rotate freely, a guide rail for guiding the guide roller which moves between the raised position and the lowered position of the door body, together with changes which occur between the two-folded state and the elongated state of the support rod; and a raising limit stopper which restricts the movement of the guide roller in a raising direction, wherein the raised state holding mechanism of a flap gate for a breakwater raises or lowers the door body in an inclined state by supplying air to the buoyancy chamber or by discharging air from the buoyancy chamber, and comprises:

movable pulleys attached to the ends of both rods of a two-rod double-acting cylinder device, with the other ends of the ropes wound around these two movable pulleys, with one rope in the direction in which the door body rises, while the other rope is in the direction in which the door body lowers, each being attached to its respective guide roller, so that a piston of the double-acting cylinder device moves according to the raising and lowering of the door body, and a stroke sensor which detects the position of the piston is provided to the double-acting cylinder device; and a hydraulic pathway between an oil tank and the double-acting cylinder device having a raising side oil supply pathway which supplies oil to a raising side oil chamber on the side of one rod where one rope is wound, and a raising side oil discharge pathway which similarly discharges oil from the raising side oil chamber on the side of the one rod, and a lowering side oil supply pathway for supplying and discharging oil in a lowering side oil chamber on the side of the other rod where the other rope is wound, and a shut-off valve being provided in the raising side oil discharge pathway to prevent the discharge of oil from the raising side oil chamber, and a check valve being provided in the raising side oil supply pathway to prevent the discharge of oil from the raising side oil chamber, if a force in a lowering direction acts on the door body during the operation of raising the door body and when raising of the door body is completed, and to prevent lowering of the door body during the operation of raising the door body and when raising of the door body has been completed.

2. A raised state holding mechanism of a flap gate for a breakwater according to claim 1, wherein an auxiliary oil supply pathway is connected to the raising side oil supply pathway.

3. A raised state holding mechanism of a flap gate for a breakwater according to claim 2, wherein a safety valve is provided in the raising side oil supply pathway or the raising side oil discharge pathway.

4. A raised state holding mechanism of a flap gate for a breakwater according to claim 1, wherein a safety valve is provided in the raising side oil supply pathway or the raising side oil discharge pathway.

* * * * *